United States Patent [19]

Becker

[11] 4,049,366

[45] Sept. 20, 1977

[54] DIAPHRAGM PUMP

[76] Inventor: Erich Becker, Glocklehofweg 13, 7812 Bad Krozingen, Germany

[21] Appl. No.: 650,761

[22] Filed: Jan. 20, 1976

[30] Foreign Application Priority Data

Jan. 23, 1975 Germany ..... 2502566

[51] Int. Cl.[2] ..... F01B 19/00; F16J 3/02; F04B 45/04

[52] U.S. Cl. ..... 417/569; 92/99

[58] Field of Search ..... 92/99, 417/437, 569, 412, 402

[56] References Cited

U.S. PATENT DOCUMENTS

| | | | |
|---|---|---|---|
| 2,144,662 | 1/1939 | Paasche | 417/413 |
| 2,185,784 | 1/1940 | Corydon et al. | 92/99 |
| 2,221,071 | 11/1940 | Barfod | 417/402 |
| 2,287,627 | 6/1942 | Malsbary et al. | 92/99 |
| 2,328,420 | 8/1943 | Brown et al. | 92/99 |
| 2,840,339 | 6/1958 | Price | 92/99 |
| 3,027,848 | 4/1962 | Merkle | 92/99 |
| 3,119,280 | 1/1964 | Mann et al. | 92/99 |
| 3,250,225 | 5/1966 | Taplin | 417/413 |
| 3,282,171 | 11/1966 | Tuckmantel | 92/99 |
| 3,354,831 | 11/1967 | Acker et al. | 92/99 |

FOREIGN PATENT DOCUMENTS

| | | | |
|---|---|---|---|
| 653,404 | 12/1962 | Canada | 417/413 |

*Primary Examiner*—William L. Freeh
*Attorney, Agent, or Firm*—Michael J. Striker

[57] ABSTRACT

A diaphragm pump, especially a vacuum pump for gases, includes at least one diaphragm extending transversely through the pump housing and defining therewith a pumping chamber. Drive means connected to the diaphragm moves the latter between a suction stroke at which gas is sucked into the pumping chamber through an inlet and a compression stroke in which the gas is pushed out of the pumping chambers through an outlet. The diaphragm is clamped at its outer periphery to the pump housing and at its central portion to the drive means moving the diaphragm between the suction and compression strokes. In order to avoid vibrations of the diaphragm during its operation, the space within the pump housing on the side of the diaphragm facing away from the pumping chamber is maintained at a pressure smaller than the inlet pressure of the gas during the suction stroke whereby striking of the unclamped portion of the diaphragm against the surface of the pump housing defining the pumping chamber is avoided and the useful life of the diaphragm increased.

13 Claims, 10 Drawing Figures

DIAPHRAGM PUMP

BACKGROUND OF THE INVENTION

The present invention relates to a diaphragm pump, especially a vacuum pump for a gaseous media, in which an elastic working diaphragm extends transversely through the pump housing to form with the latter a pumping chamber, and in which the working diaphragm is in a central region thereof connected to drive means for moving the working diaphragm between a suction and a compression stroke.

Such pumps are already known in the art. It has been ascertained that during operation of such pumps, in which on the side of the membrane, opposite the side which faces the pumping chamber, a certain counter pressure prevails, the working membrane ia liable to vibrate considerably. For instance, it has been ascertained, that in a diaphragm pump which sucks gas from a vacuum region, that is, a region of less than atmospheric pressure, and which pushes the gas under pressure greater than atmospheric pressure out of the pumping chamber, and in which the working diaphragm is subjected at its rear side with atmospheric pressure, considerable vibrations of the working diaphragm may result. This in turn will lead often to damaging of the working diaphragm in short time and corresponding inoperativeness of the pump.

SUMMARY OF THE INVENTION

It is an object of the present invention to overcome the above disadvantages of diaphragm pumps known in the art.

It is a further object of the present invention to provide a diaphragm pump in which undesirable vibrations of the working diaphragm are at least avoided to a considerable degree.

It is an additional object of the present invention to provide a diaphragm pump which is constructed of few and simple parts so that it may be manufactured at reasonable cost and will stand up properly under extended use.

With these and other objects in view, which will become apparent as the description proceeds, the diaphragm pump according to the present invention, to be used especially as vacuum pump for gas, mainly comprises a pump housing, a working diaphragm extending transversely through the housing and defining within the housing at one side of the working diaphragm pumping chamber with which fluid inlet and outlets communicate. Drive means are connected to a central portion of the working diaphragm for moving the latter through a suction stroke for sucking gas at an inlet pressure through the fluid inlet into the pumping chamber and a compression stroke for pushing gas at an outlet pressure through the fluid outlet. In addition, means are provided for maintaining on the opposite side of the working diaphragm, within the pump housing, a pressure which is smaller than the inlet pressure to thereby dampen vibrations of the working diaphragm during operation of the pump.

It has been ascertained that by creating a suitable low pressure on the rearside of the working diaphragm the tendency of the latter to vibrate is considerably reduced since by this measure a reversal of the direction of stress of the working diaphragm is substantially avoided.

This is especially the case if the pump sucks gas into the pumping chamber at less than atmospheric pressure and pushes the gas out of the pumping chamber at a pressure greater than atmospheric pressure, whereby the outlet pressure may reach values up to 25 atmospheres.

In order to maintain within the pump housing, on the side of the working diaphragm opposite the pumping chamber, a pressure which is smaller than the inlet pressure, a conduit preferably communicates at one end with a dampening space, that is the space on the opposite side of the working diaphragm within the pump housing, the outer end may be closed by a valve, and to connect pressure adjusting means, for instance a vacuum pump, to the conduit downstream of the valve. A manometer may also be provided to check the pressure in the aforementioned dampening space. In this way it is possible to determine the pressure acting on the rearside of the working diaphragm and to adjust the pressure to one smaller than the inlet pressure.

An especially advantageous construction is derived if the aforementioned dampening space is closed at one side by the working diaphragm and on the other side by an additional diaphragm which preferably is also connected to the drive means moving the working diaphragm between suction and compression stroke so that the additional diaphragm will follow the movements of the working diaphragm, whereby the volume of the dampening space will be maintained substantially constant. Correspondingly, the adjusted pressure in the dampening space acting on the rearside of the working diaphragm will also remain substantially constant.

While diaphragm pumps with two diaphragms are already known (U.S. Pat. No. 3,119,280) this pump is not provided with means to maintain on the rearside of the working diaphragm a constant pressure to thereby prevent the above-mentioned undesirable vibrations of the working diaphragm.

According to a further feature of the present invention, the working diaphragm and the additional diaphragm are driven by an eccentric drive having a connecting rod with a mushroom-shaped head arranged between and connected to the working diaphragm and the additional diaphragm, in which the cross-section of the head is arranged to provide a good support for the working diaphragm as well as to fill a major portion of the dampening space. In this way frictional contact between the two diaphragms is avoided and at the same time the free-space for a gas in the dampening space between the two diaphragms is reduced.

Preferably, the additional diaphragm is connected to the bottom face of the head of the connecting rod so that the additional diaphragm will substantially carry out the same movements as the working diaphragm. In this way the free volume in the dampening space is held substantially constant.

The upper side of the mushroom-shaped head of the connecting rod, that is the side facing the working diaphragm, is preferably covered with a thin layer of material having a low friction coefficient and such layer is preferably formed from polytetrafluorethylene. It is pointed out that it is important for the proper function of the pump that the working diaphragm may abut during the compression stroke on the upper side of the mushroom-shaped head of the connecting rod without resulting in considerable wear of the working diaphragm. It is further important that the working diaphragm will be, at the end of the compression stroke, closely adjacent and eventually also abut against the wall of the pump housing forming together with a working diaphragm the pumping chamber. Only in this way is it possible to obtain a considerable vacuum at the suction or inlet side of the pump. This desired abutment of the working diaphragm on the upper face of the head of the connecting rod and the eventual abutment thereof onto the aforementioned wall defining the pumping chamber has to be considered as essentially different from the undesired striking of the working diaphragm onto the above-mentioned parts of the pump resulting from vibrations of the working diaphragm. Such vibrations of the working diaphragm carried out in addition to its movement imparted thereto by the drive means are to be prevented, respectively essentially reduced, according to the present invention. In such undesired vibrations of the working diaphragm the latter hits against the head of the connecting rod, respectively against the wall defining the pumping chamber, to thereby result quickly in damage, respectively complete destruction of the working diaphragm.

Undesired vibrations of the two diaphragms are additionally reduced according to the present invention by clamping the two diaphragms at their peripheral edges and by maintaining the diaphragms, when in unstressed condition, substantially flat.

Preferably, the two diaphragms are provided with central openings and at the outer and inner peripheral edges with heads located in corresponding annular grooves provided respectively in the pump housing and in clamping means for clamping the outer and inner peripheral edges of the two diaphragms.

The additional diaphragm may be constructed as a safety diaphragm in which the elastically deformable portion thereof is preferably greater than that of the elastically deformable portion of the working diaphragm.

Diaphragm pumps having a working diaphragm and a safety diaphragm in which the elastically deformable portion of the safety diaphragm is greater than that of the working diaphragm are already known from the aforementioned patent, however, in this known construction the two diaphragms are not arranged substantially flat and in taut condition. To the contrary, the safety diaphragm of this known pump is provided with an annular fold projecting to one side of the remaining flat portion of the diaphragm, which fold moves parallel to the movement of the working diaphragm. This known diaphragm pump is therefore completely unsuitable for quickly successive strokes as are essentially for gaseous media. In addition, with this known pump it is practically impossible to maintain the volume of the dampening space substantially constant.

The safety diaphragm may be formed from a material which is elastically stretchable to a greater degree than the working diaphragm and the safety diaphragm may also be provided with reinforcing means, for instance a reinforcing web.

According to a further feature of the present invention, the safety diaphragm is clamped spaced from the bottom face of the head of the connecting rod so that the safety diaphragm will not engage this face of the head during the compression stroke. This distance is preferably chosen in such a manner than an undesired engagement will also not occur when the safety diaphragm makes small vibrations. In this way the useful life of the safety diaphragm is extended.

Repair and maintenance of the diaphragm pump according to the present invention should not be unnecessarily complicated as compared with diaphragm pumps having only a single diaphragm. Accordingly, the various elements connected to the connecting rod and the parts of the housing holding the diaphragms at the outer and inner peripheral edges are arranged in such a manner that they can be disassembled one after the other from the pumping chamber. For this purpose, the head of the connecting rod is formed with a central opening therethrough provided at a portion spaced from the connecting rod with an inner screw thread and a screw extending through this opening is threadedly connected to one end of the connecting rod for releasably fastening the head to the connecting rod, whereas a clamping plate provided with a central projection having an outer screw thread is threadingly engaged with the inner screw thread formed in the aforementioned opening so that the working diaphragm is clamped about its opening between the head and the clamping plate, whereas the safety diaphragm is clamped about its opening between the head and the one end of the connecting rod. In this way disassembly and subsequent reassembly of the various parts for replacement of the two diaphragms can be carried out in an extremely simple manner.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
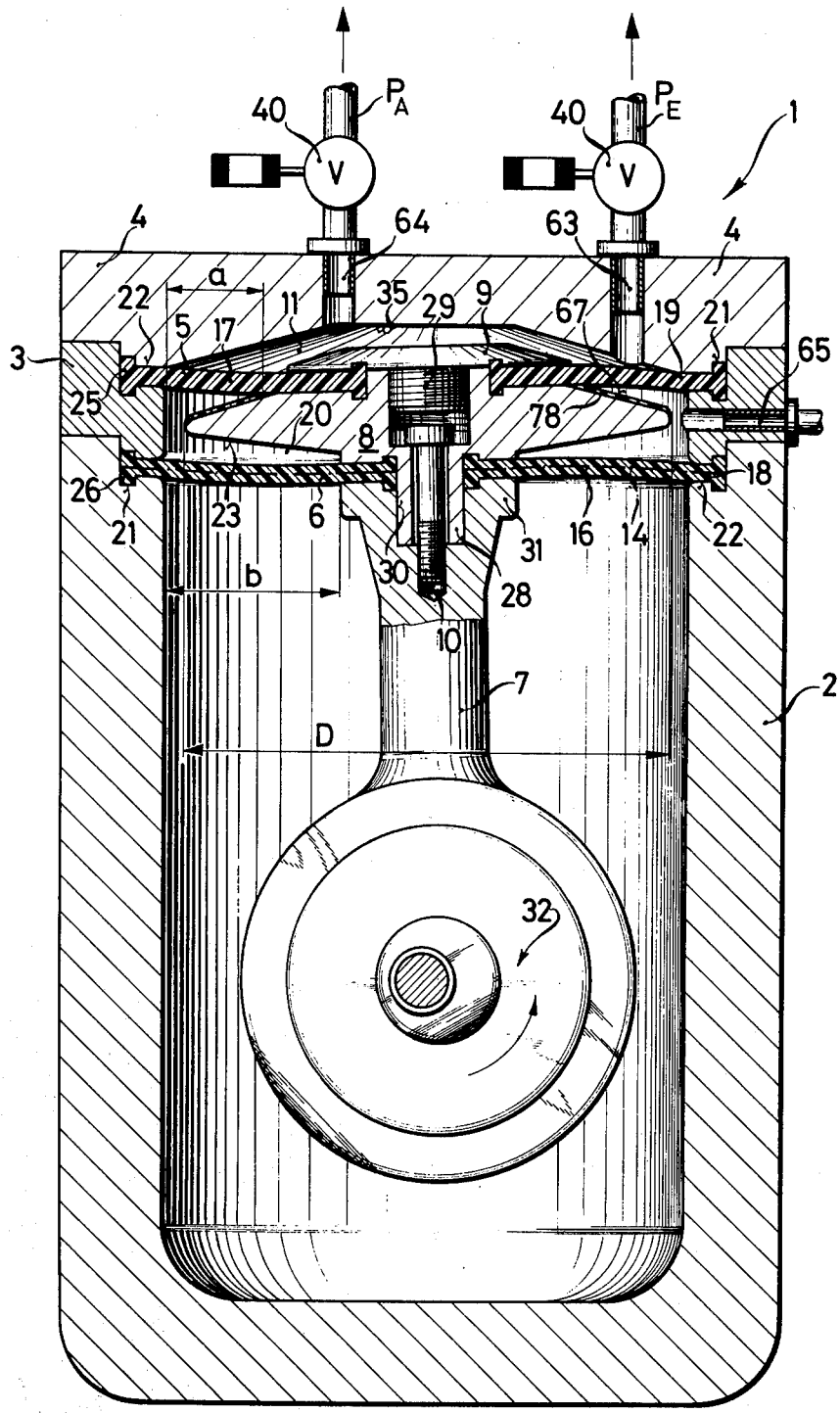
FIG. 1 is a partially sectioned side view of the diaphragm pump according to the present invention, showing the diaphragm in a neutral position.

Referring now to the drawing, and more specifically to FIG. 1 of the same, it can be seen that the pump 1 according to the present invention comprises pump housing means including a crank housing 2, an annular clamping member 3 mounted on the upper surface of the crank housing 2, and a clamping plate or cover 4 arranged above the annular clamping member 3. These three members are connected to each other by screws or the like not shown in the drawing. A working diaphragm 5 is clamped in its outer peripheral region 19 between the clamping members 3 and 4 and extend in the position shown, in substantially flat condition transversely across the housing of the pump. An additional membrane 6 extends likewise substantially flat across the housing spaced a small distance downwardly from the working diaphragm 5. The working diaphragm 5 is clamped at its outer periphery between the annular clamping member 3 and the clamping plate 4, whereas the additional diaphragm 6 is clamped between the annular clamping member 3 and the upper end face of the crank housing 2.

The working diaphragm 5 is clamped at a central region thereof between a muschroom-shaped head 8 of a connecting rod 7 and a clamping plate 9. The clamping plate 9 is provided with a central screw projection 29 which is screwed into a correspondingly threaded bore of the head 8. The head 8, in turn, is provided with a central bushing 28 which engages in a bore 30 arranged in the upper end of the connecting rod 7. The connecting rod 7 cooperates, in a known manner, at its lower end by means of a bearing 32 with an eccentric to thereby produce reciprocation of the connecting rod. The connecting rod head 8 is by means of a screw 10 connected with the connecting rod 7 and clamps thus between itself and the widened upper end 31 of the connecting rod the additional diaphragm 6 in a central region thereof. In accordance with the present invention the two diaphragms 5 and 6 extend, in the position shown in FIG. 1, that is in a position midway between the upper and the lower dead-center position of the connecting rod 7, a radial direction substantially flat through the housing of the pump. In this position the two diaphragms are held either tensionless or in the respective planes under a slight pretension and have in the elastic regions thereof no deformations deviating from the planar arrangement of the diaphragms.

The two diaphragms 5 and 6 are however provided at the outer and inner peripheral edges with beads 25 and 26 respectively located in correspondingly shaped grooves 21 and 31 respectively formed in the upper end of the crank housing 2, the annular clamping member 3, the clamping plate 4, the upper end of the connecting rod 7, at opposite central portions of the head 8 and in the bottom face of the clamping plate 9. When during movement of the connecting rod 7 the diaphragms 5 and 6 are moved out of the neutral position shown in FIG. 1, the diaphragms are held in tensioned condition between the clamping regions 19 and 22 thereof.

The working diaphragm 5 forms with the inner frusto-conical surface portion 35 of the clamping plate or cover 4 a pumping chamber 11 with which a fluid inlet 63 and a fluid outlet 64 through the cover 4 communicate. Oneway valves 40 are arranged in conduits respectively connected to the outer ends of the fluid inlet 63 and the fluid outlet 64 respectively permitting passage of a gas through the inlet 63 into the pumping chamber 11 during the suction stroke of the drive means connected to the diaphragms and withdrawal of fluid from the pumping chamber 11 during the compression stroke of the drive means.

Due to the flat arrangement of the two diaphragms in the neutral position as shown in FIG. 1 and due to the clamping of the diaphragms at the inner and outer peripheries thereof a fluttering of the membranes in the elastic regions thereof is already counteracted to a certain degree. According to the present invention a pressure is maintained in the dampening space 20 between the two diaphragms which is correlated to the suction or inlet pressure $P_E$ prevailing in the pumping chamber 11 during the suction stroke of the connecting rod 7 and the membranes connected thereto, whereby oscillations or vibrations of the working diaphragm 5 will be essentially prevented. The working diaphragm 5 has during the suction stroke the tendency to curve toward the clamping plate 5, while during the compression stroke in which a pressure $P_A$ will occur in the pumping chamber 11, the working diaphragm 5 has the tendency to curve in the opposite direction toward the head 8. Without maintaining in accordance with the present invention in the dampening space 20, that is on the rear face of the working diaphragm 5, a pressure $P_R$ which is lower than the inlet pressure $P_E$, the working diaphragm 5 would therefore swing from a position curved toward the clamping plate 4 to a position curved toward the head 8.

By maintaining at the bottom face of the working diaphragm 5 a pressure $P_R$ which is lower than the suction pressure $P_E$, a curving of the diaphragm 5 during the suction stroke toward the clamping plate 4 is thus prevented.

Figure 4A:
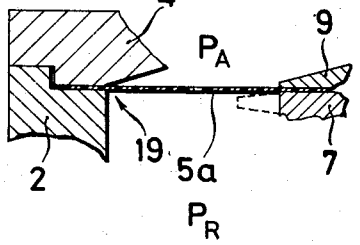
FIG. 4*a*–4*c* schematically illustrate the working diaphragm of a diaphragm pump according to the prior art during a pumping cycle.
Figure 4B:
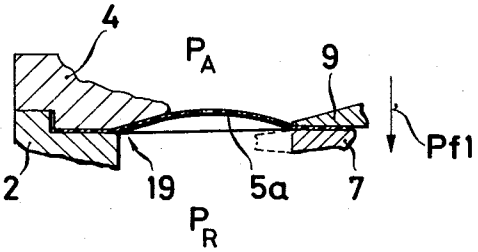
Figure 4C:
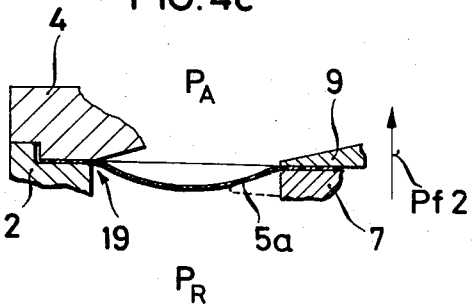

FIGS. 4*a* - 4*c* and FIGS. 5*a* - 5*c* respectively show the movements of the working diaphragm 5*a*, respectively 5 during the operation of the pump. In these schematic Figures only the portions of the pump are shown which clamp the diaphragms at the inner region 22 and the outer region 19. FIGS. 4*a* - 4*c* illustrate the curvatures an undampened diaphragm 5*a* will assume during the operation of such pump between the clamped regions thereof. FIG. 4*a* shows the diaphragm 5*a* in the neutral position, whereas FIG. 4*b* shows the diaphragm 5*a* during the suction stroke when the connecting rod attached to its central region moves in the direction of the arrow Pf1 during the suction stroke, and FIG. 4*c* shows the corresponding position of the diaphragm 5*a* when the connecting rod 7 moves in the direction of the arrow Pf2 during the compression stroke. As can be clearly ascertained from FIGS. 4*b* and 4*c* the diaphragm 5*a* will alternatively curve in opposite directions upwardly and downwardly from the position shown in FIG. 4*a*.

Experiments have shown that, especially striking of the diaphragm 5*a* during the suction stroke onto the inner surface 35 (FIG. 1) of the clamping plate 4, considerably reduces the working life of the diaphragm 5*a*. This disadvantage of a diaphragm pump schematically illustrated in FIGS. 4*a* - 4*c* is avoided with the pump construction according to the present invention in which a pressure $P_R$ is maintained in a dampening space 20 between the working diaphragm 5 and the additional diaphragm 6, which is smaller than the inlet pressure $P_E$.

The theoretical relationship between the inlet or suction pressure $P_E$ and the pressure $P_R$ to be maintained in the dampening space 20 at the rearface of the working diaphragm 5 is preferably $P_{R(th)} = 0.75\ P_E$, but practically this relationship should be $P_R = 0.70\ P_E$. This relationship is illustrated in the diaphragm of FIG. 6 in which the theoretical value of $P_{R(th)}$ is shown in a dash-dotted line and the preferred practical value of $P_R$ is shown in full line.

Figure 6:
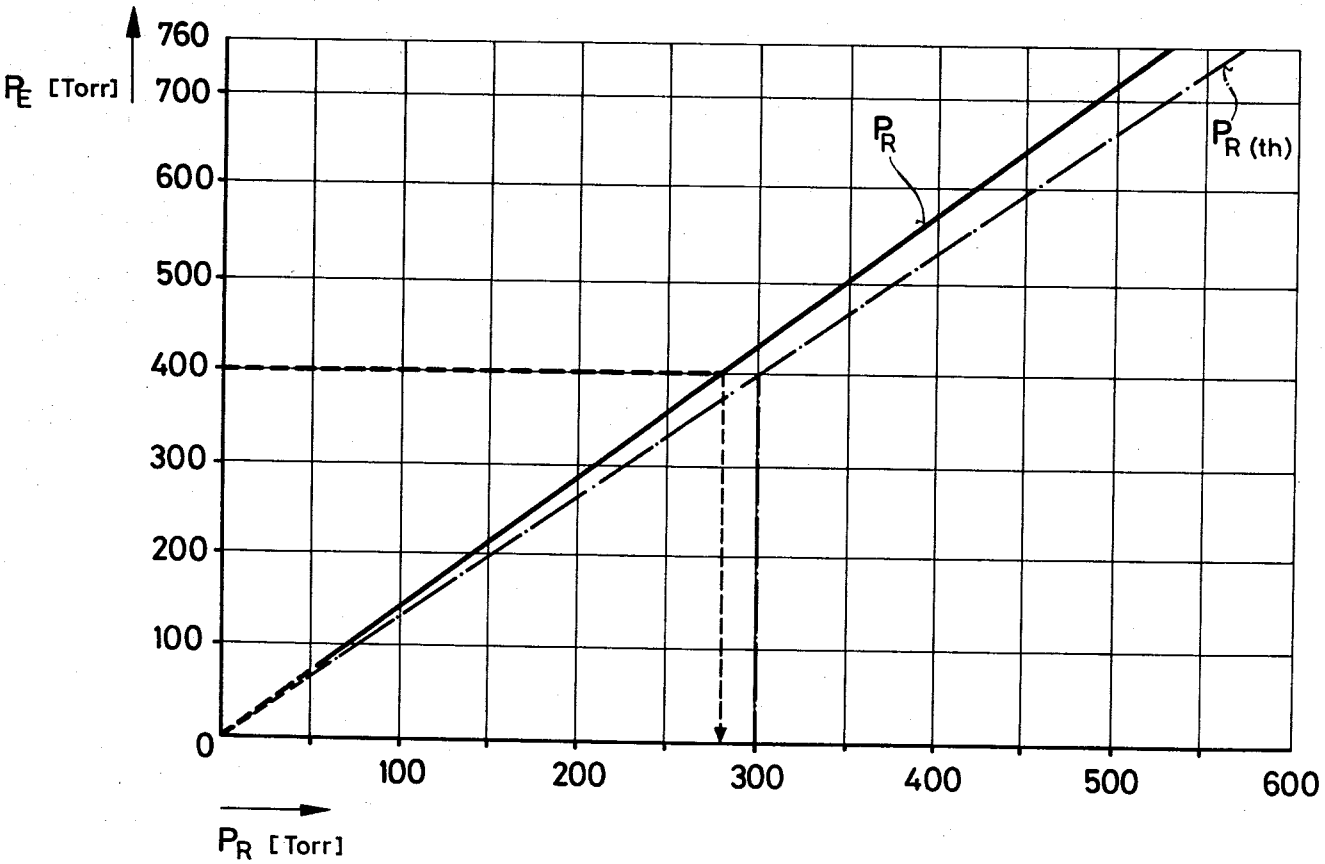
FIG. 6 is a graph showing the relationship between the inlet pressure of the pump and the pressure to be maintained in the space between the two diaphragms in the pump according to the present invention.

If, for instance, the inlet pressure $P_E$ is equal to 400 Torr, then the theoretical reduced pressure $P_R$ to be maintained in the dampening space 20 can be found from the diaphragm shown in FIG. 6 as 300 Torr. For safety reasons, an even lower pressure is practically chosen, that is 280 Torr as can be seen from the diagram of FIG. 6.

In other words, the pressure $P_R$ should be lower than the inlet $P_E$ and it is not detrimental for the proper working of the pump if $P_R$ is considerably smaller than the value established by the diagram shown in FIG. 6.

Only in the latter case, the energy for establishing, respectively maintaining such a low pressure $P_R$ is unnecessarily large. The above-mentioned relationship between $P_R$ and $P_E$ established by the inventor constitutes therefore an optimal relationship.

When the pressure $P_E$ approaches a zero value, it is questionable whether the pressure $P_R$ can be practically maintained according to the above-mentioned formulas. The lines $P_R$ and $P_{R(th)}$ are therefore in this region adjacent zero value only shown in dotted lines.

When the pressure $P_E$ changes during operation of the pump, that is when the pressure gradually decreases then the pressure $P_R$ may be changed correspondingly or may be set originally at a pressure corresponding to the lowest inlet pressure which will be reached during operation of the pump.

Figure 2:
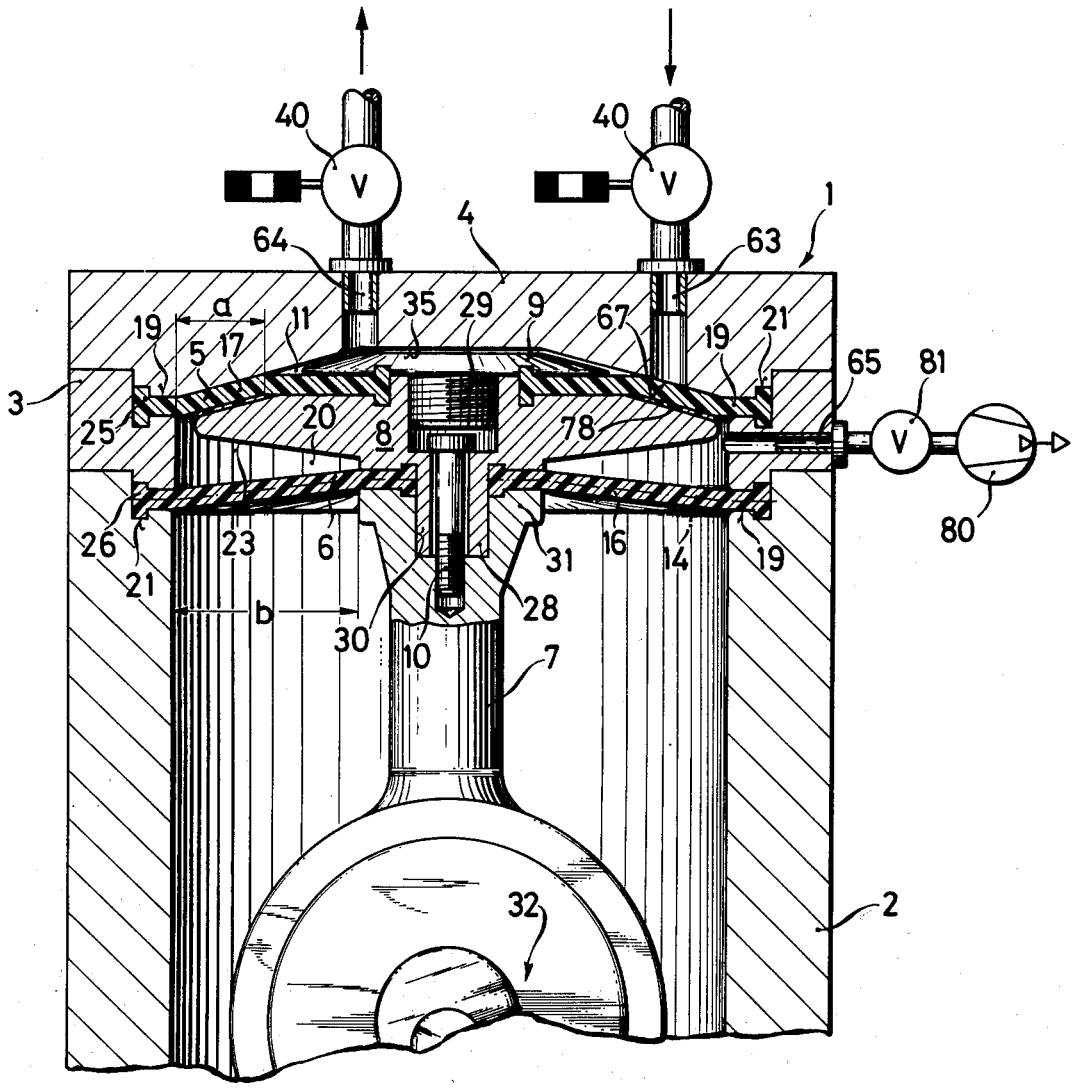
FIG. 2 is a partial sectioned, partial side view similar to FIG. 1, showing the crank drive in an upper deadcenter position.

The means for establishing the desired pressure in the space 20 are schematically illustrated in FIG. 2. As shown therein, a conduit 65 communicates at the inner end with the space 20 while a valve 81 is connected to a portion of the conduit projecting beyond the pump housing to open and close the conduit, and a suction pump 80 is arranged downstream of the valve 81. The suction pump 80 can, for instance during continuous operation of the pump according to the present invention, be operated simultaneously with the pump to thereby maintain the desired underpressure $P_R$ in the space 20. It is however also possible to close the valve 81 after the desired underpressure $P_R$ is obtained in the space 20. To ascertain the pressure prevailing in the space 20 and manometer or pressure gauge, not shown in the drawing, may be provided in communication with the space 20.

According to the present invention excessive wear of the rear face of the working diaphragm 5, that is the face directed toward the head 8, is also avoided. This is obtained by forming the head 8 in such a manner to provide during the compression stroke, as shown in FIG. 2, a proper support for the rear face of the working diaphragm 5 and by providing on the upper face 67 of the head 8, at least at a portion thereof which will come in contact with the freely flexible portions 17 of the working diaphragm 5 a thin layer 78 of a material having a low friction coefficient. Essentially thereby is also that the movement of the head 8 and the working diaphragm 5 are in the same direction so that a relative movement between these two members will be relatively small. The movement of the working diaphragm 5 relative to the surface 35 of the clamping plate 4 is however essentially greater so that the impingement on the surface by an undampened membrane during the suction stroke as shown in FIG. 4*b* is considerably greater.

Figure 5A:
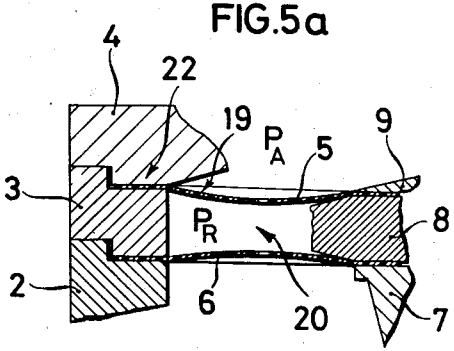
FIG. 5*a*–5*c* illustrate the working and safety diaphragms of the pump according to the present invention during a pumping cycle.
Figure 5B:
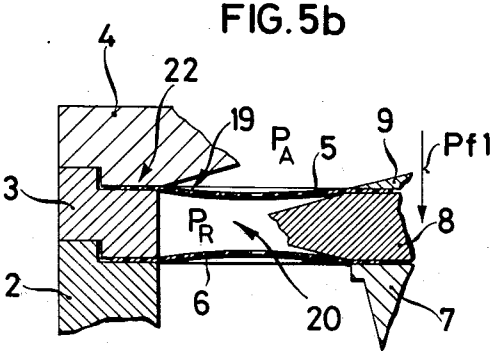
Figure 5C:
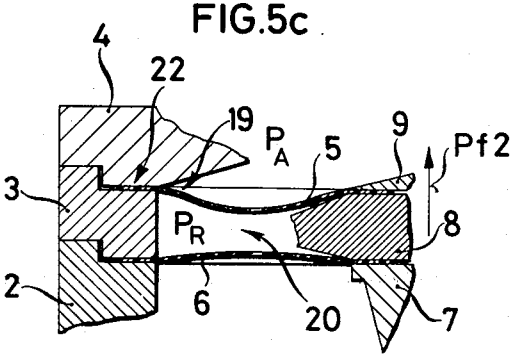

Therefore, the maintenance of a pressure $P_R$ in the space 20, which is reduced relative to the inlet pressure $P_E$, is, as shown in FIG. 5*a*–5*c*, especially advantageous. The working diaphragm 5 will be in this arrangement essentially only acted upon one side, due to the reduced pressure $P_R$, so that alternating loading of the diaphragm 5 and vibrations of the diaphragm 5 leading to a fluttering of this diaphragm and to a considerable wear of the upper face thereof are practically avoided. As mentioned before, the head 8 of the connecting rod 7 is located in the dampening space 20 between the working diaphragm 5 and the additional diaphragm 6. Thus, the head 8 reduces, in a desired manner, the volume of the dampening space 20 to be filled with a gaseous medium.

The clamping regions 22 of the additional diaphragm 6 are arranged at such a distance from the bottom face 23 of the head 8 that the additional membrane will not come in contact with the face 23 of the head. The arrangement is made in such a manner that the diaphragm 6 will also not come in contact with the face 23 of the head 8 even if the diaphragm 6 should vibrate to a certain extent.

In order to increase the useful life of the additional diaphragm 6, which serves as a safety diaphragm, in such a manner that the useful life of the safety diaphragm 6 will be greater than that of the working diaphragm 5, the unclamped elastically deformable annular portion 16 of the safety diaphragm 6 has a radial extension *b*(FIG. 1) which is to an essential degree greater than the radial extension *a* of the unclamped elastically deformable annular portion 17 of the working diaphragm 5.

Figure 3:
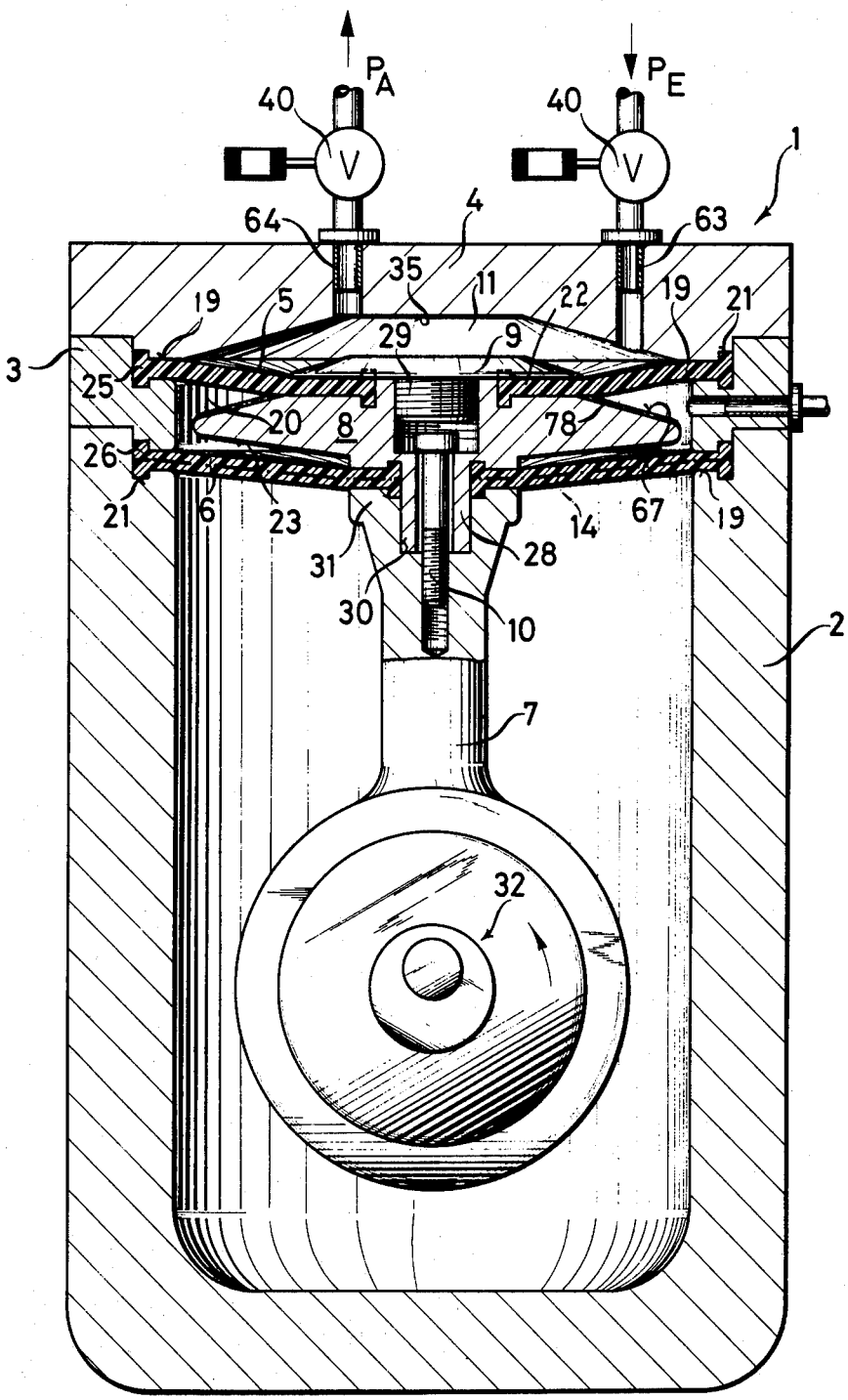
FIG. 3 is a partial sectioned side view similar to FIG. 1, but showing the crank drive in its lower deadcenter position.

In order to extend the useful life of the safety diaphragm 6, as compared to that of the working diaphragm 5, the safety diaphragm 6 may also be provided with a reinforcement 14 as schematically indicated in dash-dotted lines in FIGS. 1–3. Such a reinforcement may comprise, for instance, a flexible web of a material stronger than the material from which the remainder of the safety diaphragm 6 is formed. The safety diaphragm 6 can also be formed from a material which is elastically stretchable to a greater extent than the working diaphragm 5.

Preferably, both diaphragms 5 and 6 are made from the same material, for instance, neoprene or vitan and each preferably has a thickness of 1 to 5 mm.

As clearly shown in FIGS. 1–3, the head 8 tapers in radial outward direction, that is the bottom face 23 of the head extends from its inner portion upwardly inclined towards the outer periphery thereof so that the bottom face 23 will not come into contact with the safety diaphragm 6.

The upper surface 67 of the head 8 extends from an inner portion downwardly inclined toward the outer periphery of the head. The inclined surface 67 is provided with the layer 78 which has a low friction and adhesion coefficient and this layer is preferably formed from tetrafluorethylene. This will assure that during the compression stroke the friction between the working diaphragm and the upper face 67 of the head 8 will be very small. Correspondingly the wear and the heating up of the working diaphragm due to friction will be relatively small.

The above-mentioned operation of the pump, that is aspiration of the gaseous medium from a partial vacuum and discharge of the medium under pressure higher than atmospheric pressure, whereby this discharge pressure may reach a pressure of about 25 atmospheres, occurs often in a closed system. In such a closed system radioactive, poisonous or otherwise dangerous gaseous mediums may be circulated in which these mediums may also be of considerable value. Therefore a loss of such medium, respectively discharge of medium out of the closed circuit is especially undesirable. It is for this reason that the pump according to the present invention is provided with a safety diaphragm. This safety diaphragm will also assure that during rupture of the working diaphragm an especially valuable medium will not be essentially contaminated by air or the like. In the arrangement according to the present invention the additional diaphragm 6 will not only form a safety diaphragm but serves also to close the dampening space 20 at one side so that a desired underpressure may be maintained in this dampening space.

By arranging the head 8 within the dampening space 20 and by maintaining in the dampening space a reduced pressure, a relatively small amount of gas will reside in the dampening space 20. Therefore, when the working diaphragm 5 breaks and the gaseous medium flows in an undesirable manner from the dampening space 20 into the closed system the amount of such medium which will penetrate into the closed system will be relatively small since a greatly reduced pressure is maintained in the dampening space 20. Therefore, during rupture of the working diaphragm 5 the flow medium will rather flow from the closed system into the dampening space 20 than flow from the dampening space 20 into the closed system.

The danger of contamination of the gas to be pumped can also be reduced by providing in the dampening space 20 the same gas as is pumped by the pump, but of course with a correspondingly reduced pressure.

As can be seen from FIGS. 1–3 the upper surface 67 of the head 8 as well as the upper surface of the clamping plate 9 matches the surface portion 35 of the clamping plate or cover 4. Likewise, the lower surface 23 of the head 8 is formed so that the safety diaphragm 6 will not come into contact with this surface during operation of the pump. Thereby the distance between the two diaphragms 5 and 6 is held as small as possible, but large enough to prevent contact between the two diaphragms.

The outer diameter D of the head 8 is as large as possible, of course under consideration that the head during the operation of the pump will not contact the annular clamping member 3.

It will be understood that each of the elements described above, or two or more together, may also find a useful application in other types of diaphragm pumps differing from the types described above.

While the invention has been illustrated and described as embodied in a diaphragm pump constructed to avoid undesired vibrations of the diaphragm of diaphragms during the operation of the pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A diaphragm pump, especially a vacuum pump for gas, comprising pump housing means; a working diaphragm extending transversely through said pump housing means and defining at one side of said working diaphragm within said pump housing means a pumping chamber; fluid inlet and outlet means communicating with said pumping chamber; a safety diaphragm extending transversely through said pump housing means spaced from the opposite side of said working diaphragm and defining with the latter and part of said pump housing means a fluid-tightly enclosed space; drive means comprising a connecting rod having a substantially mushroom-shaped head positively connected to central portions of said diaphragms, said head extending between said diaphragms and being constructed to support a portion of said working diaphragm around said central portion of the latter and to contact said safety diaphragm over a smaller area than said working diaphragm while keeping said diaphragms separated through a small distance from each other, said head having an outer periphery closely adjacent to the inner periphery of said housing part and a volume to fill a major portion of said enclosed space, said diaphragms having a neutral position in which said diaphragms are substantially unstressed and located in two parallel planes and the central portions of said diaphragms being moved by said drive means to opposite sides of said neutral position so that the working diaphragm performs a suction stroke for sucking gas at an inlet pressure through said fluid inlet into said pumping chamber and a compression stroke for discharging gas at an outlet pressure through said fluid outlet, both of said diaphragms are in stressed condition during movement away from said neutral position; and means for maintaining in said enclosed space a pressure which is smaller than said inlet pressure to thereby dampen vibration of said working diaphragm during operation of said pump.

2. A diaphragm pump as defined in claim 1, wherein said safety diaphragm is formed from a material which is elastically stretchable to a greater extent than that of said working diaphragm.

3. A diaphragm pump as defined in claim 1, wherein each of said diaphragms is formed with a central opening, said head being formed with a central opening therethrough having a portion spaced from said connecting rod and provided with an inner screw thread; a screw extending through said opening and threadedly connected to one end of said connecting rod for releasably fastening said head to said connecting rod, and including a clamping plate provided with a central projection having an outer screw thread and being threadingly engaged with said inner screw thread, said working diaphragm being clamped about its opening between said head and said clamping plate and said safety diaphragm being clamped about its opening between said head and said one end of said connecting rod.

4. A diaphragm pump as defined in claim 1, wherein said enclosed space is filled with the same medium as that pumped by said pump, said medium in said space being maintained at said smaller pressure.

5. A diaphragm pump as defined in claim 1, wherein said smaller pressure maintaining means comprises a conduit communicating at one end with enclosed space at said opposite side of said working diaphragm, a valve in said conduit means, and a suction pump connected to the other end of said conduit downstream of said valve.

6. A diaphragm pump as defined in claim 1, and including a layer of material having a low friction coefficient covering that surface of said head which faces said opposite side of said working diaphragm.

7. A diaphragm pump as defined in claim 6, wherein said material is polytetrafluoroethylene.

8. A diaphragm pump as defined in claim 1, wherein each of said diaphragms is provided with a central opening and along its outer periphery and about its central opening with an annular bead, and including annular clamping means forming part of said housing means and formed with annular grooves receiving and clamping the annular beads at the outer periphery of said diaphragms, and second clamping means on said head formed with annular grooves receiving and clamping said annular beads about the central openings of said diaphragms.

9. A diaphragm pump as defined in claim 8, wherein the diaphragms are formed from an elastically deformable material and wherein the annular elastically deformable portion of said safety diaphragm between said annular and said second clamping means of said safety diaphragm is greater than that of said working diaphragm.

10. A diaphragm pump as defined in claim 8, wherein said second clamping means comprise a clamping plate connected to said head for clamping the annular bead of said working diaphragm about the central opening thereof, and wherein said head, on the side thereof facing said opposite side of said working diaphragm and said clamping plate have a configuration matching the configuration of a surface defining the pumping chamber and facing said one side of said working diaphragm.

11. A diaphragm pump as defined in claim 10, wherein said pump housing means comprises a cover removable connected to the remainder of said pump housing means and having an inner surface portion constituting said surface, said clamping plate being removably connected to said head and the latter being removably connected to said connecting rod.

12. A diaphragm pump as defined in claim 1, and including reinforcing means provided in said safety diaphragm.

13. A diaphragm pump as defined in claim 12, wherein said reinforcing means comprises a reinforcing web.

* * * * *